US007383676B1

(12) United States Patent
Schmidt et al.

(10) Patent No.: US 7,383,676 B1
(45) Date of Patent: Jun. 10, 2008

(54) PACKAGING MACHINE FOR BEDDING PRODUCTS

(75) Inventors: Lee Schmidt, Belle Plaine, MN (US); Preston B. Dasher, Lawrenceville, GA (US); Elvin C. Price, Dacula, GA (US); Tadeusz Olewicz, Hoschton, GA (US)

(73) Assignee: Atlanta Attachment Company, Lawrenceville, GA (US)

( * ) Notice: Subject to any disclaimer, the term of this patent is extended or adjusted under 35 U.S.C. 154(b) by 32 days.

(21) Appl. No.: 11/372,710

(22) Filed: Mar. 10, 2006

Related U.S. Application Data

(60) Provisional application No. 60/708,033, filed on Aug. 12, 2005, provisional application No. 60/660,456, filed on Mar. 10, 2005.

(51) Int. Cl.
*B65B 9/02* (2006.01)
*B65B 51/14* (2006.01)

(52) U.S. Cl. ..... 53/450; 53/477; 53/553; 53/374.8

(58) Field of Classification Search ..... 53/553, 53/374.8, 373.7, 450, 477
See application file for complete search history.

(56) References Cited

U.S. PATENT DOCUMENTS 3,564,810 A * 2/1971 Faletti et al. ..... 53/463
3,965,653 A * 6/1976 Lerner ..... 53/374.8
4,711,067 A 12/1987 Magni
4,779,400 A * 10/1988 Hoskinson et al. ..... 53/374.8
4,858,416 A * 8/1989 Monaghan ..... 53/553
4,869,051 A * 9/1989 Shifley et al. ..... 53/374.8
5,042,227 A 8/1991 Merry
5,172,629 A 12/1992 Merry
5,271,498 A 12/1993 Gillespie
5,622,030 A 4/1997 Steed et al.
5,664,408 A 9/1997 Chesterfield
RE36,142 E 3/1999 Steed et al.
5,934,041 A 8/1999 Rudolf et al.
6,021,725 A 2/2000 Resta
6,032,345 A 3/2000 Resta
6,079,341 A 6/2000 Resta
6,098,378 A 8/2000 Wyatt
6,129,030 A 10/2000 Resta (Continued)

OTHER PUBLICATIONS

Dueffe Group, Dueffe SM 205, Description SM 205 Automatic Packager published on www.dueffeitaly.it.

*Primary Examiner*—Stephen F. Gerrity
(74) *Attorney, Agent, or Firm*—Womble Carlyle Sandridge & Rice, PLLC

(57) ABSTRACT

A packaging machine for packaging a product. The machine has a frame for supporting the product and a source of packaging material for supplying packaging material into a position to be engaged by and at least partially surround the product. At least one upper sealing assembly is adapted to move between an actuated position and a non-actuated position. The upper sealing assembly comprises at least one sealing element for forming a seal along adjacent edges of the packaging material. At least one lower sealing assembly is adapted for cooperating engagement with the upper sealing assembly in its actuated position. The at least one upper and lower sealing assemblies are positioned for clamping engagement of the packaging material therebetween for forming the seal when the upper sealing assembly is moved to its actuated position in engagement with the lower sealing assembly.

11 Claims, 10 Drawing Sheets

U.S. PATENT DOCUMENTS 6,178,723 B1 1/2001 Mossbeck
6,220,457 B1 4/2001 Resta
6,223,666 B1 5/2001 Resta
6,250,238 B1 6/2001 Resta
6,273,257 B1 8/2001 Mossbeck
6,298,510 B1 10/2001 Mossbeck
6,357,209 B1 3/2002 Mossbeck et al.
6,408,773 B2 6/2002 Resta
6,467,239 B2 10/2002 Mossbeck et al.
6,502,375 B2 1/2003 Resta
6,634,307 B2 10/2003 Resta
6,640,520 B2 11/2003 Gecic
6,702,224 B2 3/2004 Resta
6,735,923 B1 5/2004 Resta
6,739,107 B1 5/2004 Lewis et al.
6,779,471 B2 8/2004 Resta
6,789,371 B1 * 9/2004 Buysman et al. ..... 53/374.8
6,804,940 B2 10/2004 Resta
6,810,643 B1 11/2004 Gecic et al.
6,892,448 B2 5/2005 Gecic
6,901,722 B2 6/2005 Dextraze et al.
6,983,706 B2 1/2006 Marcangelo
7,000,269 B2 2/2006 Borda
7,017,854 B2 3/2006 Gecic et al.
7,021,227 B2 4/2006 Marcangelo
7,059,101 B2 6/2006 Dextraze et al.
7,147,106 B2 12/2006 Kowalski et al.
2001/0010199 A1 8/2001 Resta
2001/0022061 A1 9/2001 Resta
2002/0069803 A1 6/2002 Resta
2002/0092945 A1 7/2002 Resta
2002/0157584 A1 10/2002 Resta
2003/0074863 A1 4/2003 Mossbeck
2003/0079339 A1 5/2003 Gecic
2004/0096303 A1 5/2004 Resta
2006/0231436 A1 10/2006 Spinks et al.
2007/0204566 A1 9/2007 Lee

* cited by examiner

PACKAGING MACHINE FOR BEDDING PRODUCTS

CROSS-REFERENCE TO RELATED APPLICATIONS

This application claims the benefit of both U.S. Provisional Application Ser. No. 60/660,456, filed Mar. 10, 2005 and entitled "Packaging System for Bedding Products" and U.S. Provisional Application Ser. No. 60/708,033, filed Aug. 12, 2005 and entitled "Packaging System for Bedding Products", the entire contents of both of which are hereby incorporated by reference as if presented herein in their entirety.

FIELD OF THE INVENTION

The present invention generally relates to a packaging machine for packaging products such as bedding and furniture products, and in particular to a system and method for packaging mattresses, foundations, cushions, and other similar products in a protective film or packaging material for transport and storage.

BACKGROUND OF THE INVENTION

Bedding and furniture products such as mattresses, box springs, foundations, futons, cushions and other, similar products generally are shrink wrapped or otherwise wrapped in a plastic sheeting material for protection during storage and transport. Typically, a polyethylene sheeting material or similar, relatively durable plastic wrapping material or film will be used to encase the mattresses or other bedding or furniture products with the edges of the plastic sheeting material or film generally being sealed or otherwise attached together to substantially encapsulate or enclose the product therein. The plastic sheeting material generally will protect the mattresses or other products from being soiled and/or stained with liquids, dirt or other debris, as well as protect the sides and ends of the mattresses from damage during handling and storage as the mattresses are stacked and/or moved along their side or end edges.

A problem that exists with most conventional packaging machines, however, is that such machines often are limited in the speeds they can package the mattresses, bedding or furniture products, which can lead to a slow down or delay in the completion of the manufacture of such products for shipment. Still further, such machines typically are in substantially constant use, and as a result, can break down frequently or experience wear on their components. For example, over time, the sealing assemblies used for heat-sealing the plastic sheeting material about the mattresses, etc., can become fouled with melted plastic, or their heating elements can burn out. In such an event, the sealing assemblies in most conventional wrapping machines generally must be completely disassembled and substantially rebuilt to repair them, which accordingly can cause the packaging machine to be out of service for extensive periods of time.

Accordingly, it can be seen that a need exists for a system and method for packaging bedding and/or furniture products that addresses the forgoing and other related and unrelated problems in the art.

SUMMARY OF THE INVENTION

In general, a packaging machine according to one embodiment of the invention is used for packaging a product and comprises a frame for supporting the product as the product is moved along a path of travel. A source of packaging material is positioned on the frame for supplying packaging material into a position to be engaged by and at least partially surround the product as the product is moved along the path of travel. At least one upper sealing assembly is moveably mounted on the frame and is adapted to move between an actuated position and a non-actuated position. The upper sealing assembly comprises at least one sealing element for forming a seal along adjacent edges of the packaging material, a support moveably mounted on the frame, and a bracket attached to the support for supporting the sealing element. The sealing element is adapted for removal from the bracket when the bracket is attached to the support and the support is attached to the frame. At least one lower sealing assembly is mounted on the frame in a position adapted for cooperating engagement with the upper sealing assembly in its actuated position. The upper and lower sealing assemblies are positioned for clamping engagement of the packaging material therebetween for forming the seal when the upper sealing assembly is moved to its actuated position in engagement with the lower sealing assembly.

In another aspect of the invention, the packaging machine generally comprises a frame for supporting the product in the machine and having an input end and an output end. A first source of packaging material is mounted on the frame for supplying a first web of packaging material, and a second source of packaging material is mounted on the frame for supplying a second web of packaging material. The first and second webs of packaging material are adapted to at least partially surround the product when the product is moved from the input end towards the output end of the machine. At least one upper sealing assembly is moveably mounted on the frame for movement between an actuated position and a non-actuated position. The upper sealing assembly comprises at least one sealing element for forming a bond between the first and second webs of material. At least one lower sealing assembly is mounted on the frame in a position adapted for cooperating engagement with the upper sealing assembly when the upper sealing assembly is in its actuated position with the first and second webs engaged therebetween for forming the bond between the first and second webs. The lower sealing assembly comprises a support and a replaceable lower sealing element having a nonstick surface received and supported on the support. The lower sealing assembly can further include a dispenser mechanism to provide a source or supply of new, nonstick sealing material as needed. Thus, when the nonstick material of the lower sealing element needs replacement, a used portion of the nonstick material from the lower sealing assembly can be detached and a new, unused section of sealing material unwound from a roll of nonstick material and attached to the lower sealing assembly.

In still another aspect of the invention, the packaging machine comprises a frame for supporting the product as the product is moved along a path of travel. One or more webs of packaging material are fed into a position to be engaged by and at least partially surround the product as the product is moved along the path of travel. At least one upper sealing assembly is moveably mounted on the frame and adapted to move between an actuated position and a non-actuated position. At least one lower sealing assembly is mounted on the frame in a position adapted for cooperating engagement with the upper sealing assembly in its actuated position. The upper and lower sealing assemblies thus engage the edges of the packaging material in clamping engagement for forming the seal when the upper sealing assembly is moved to its actuated position in engagement with the lower sealing assembly. A compression assembly further can be mounted on the frame for compressing the product prior to movement of the sealing assembly to the actuated position. The compression assembly generally comprises a compression bar and a first and second actuator respectively positioned adjacent opposite ends of the compression bar.

Various objects, features and advantages of the present invention will become apparent to those skilled in the art upon reading the following detailed description, when taken in conjunction with the accompanying drawings.

BRIEF DESCRIPTION OF THE DRAWINGS

Corresponding parts are designated by corresponding reference numbers throughout the drawings.

DETAILED DESCRIPTION OF THE INVENTION

Figure 1A:
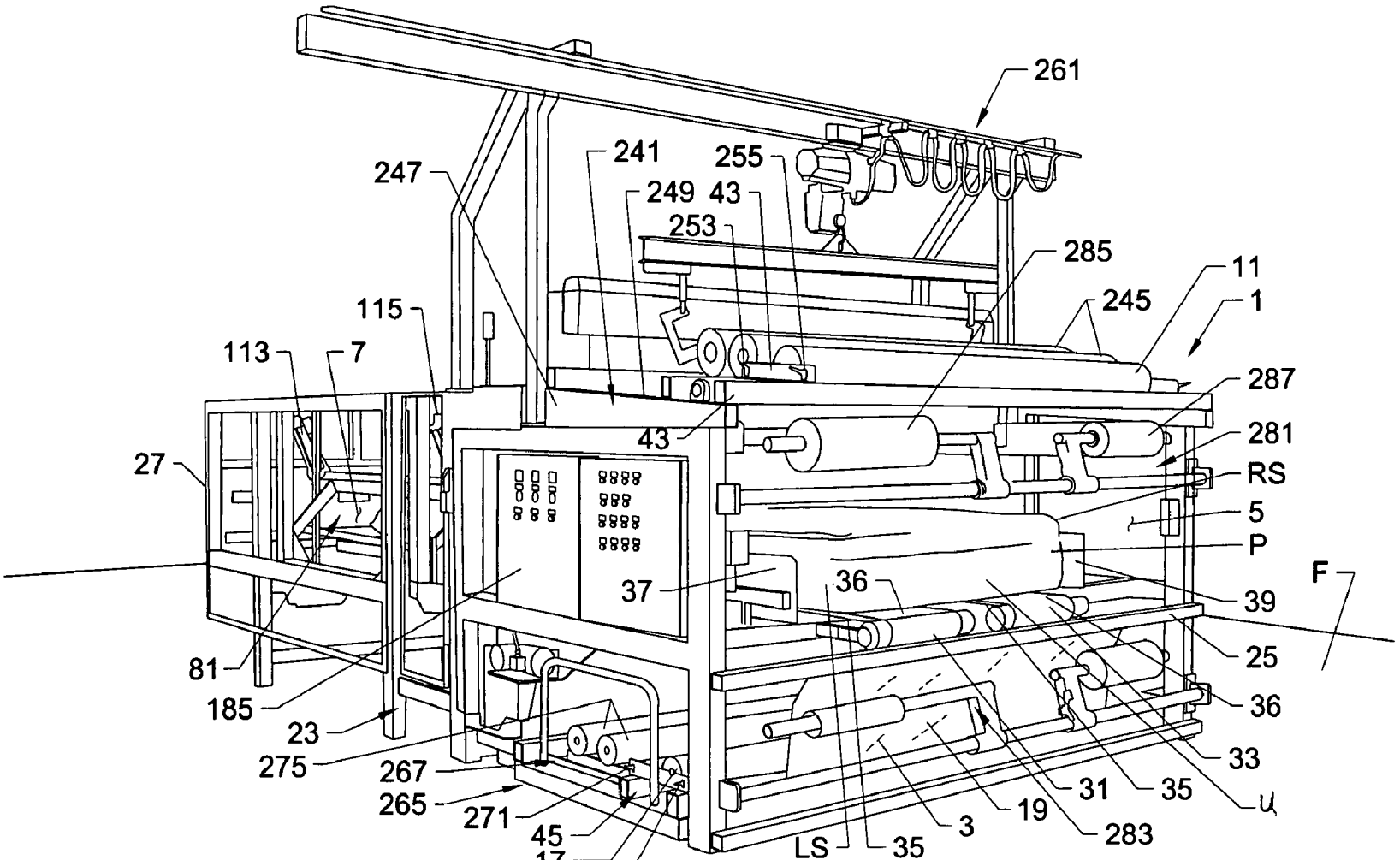
FIG. 1A is a perspective of a packaging machine according to the principles of the present invention.

As shown in the drawings, the present invention generally relates to a packaging machine, generally designated at 1, for packaging various types of products P in a packaging material such as plastic sheeting, wrapping material or film, generally indicated at 3. The packaging machine 1 of the present invention being illustrated herein for use in packaging bedding products P such as mattresses, box springs or foundations, futons, cushions and/or foam padding, although it will be understood by those skilled in the art that various other types of products including furniture and other similar bulky products also can be packaged using the system of the present invention. Accordingly, while the term "mattress" will be used to describe the product P being packaged in an exemplary embodiment of the present invention as discussed hereinafter, it will be understood that the present invention should not be limited solely to the packaging of mattresses, but also can be used for other bedding, furniture, or other similar products as well.

As shown in FIGS. 1A-2B, the packaging machine 1 has a front product receiving area, generally indicated at 5, at the front of the machine for receiving a product P to be packaged, and a packaging area, generally indicated at 7, toward the rear of the machine 1 for enclosing and sealing the product in the packaging material 3. In the illustrated embodiment, the packaging machine 1 has a first roll 11 (broadly "source") of packaging material at the top of the machine for supplying an upper web 13 of packaging material to the packaging area 7 and a second roll 17 of packaging material at the bottom of the machine for supplying a lower web 19 of packaging material to the packaging area of the machine. The packaging machine 1 of the present invention generally includes a frame, generally indicated at 23, for supporting the machine, which frame 23 typically is constructed of a high strength material such as steel or similar materials, with the frame defining an input end 25 at product receiving area 5 at the front of the machine and an output end 27 at the end of the packaging area 7 at the rear of the machine.

Figure 1B:
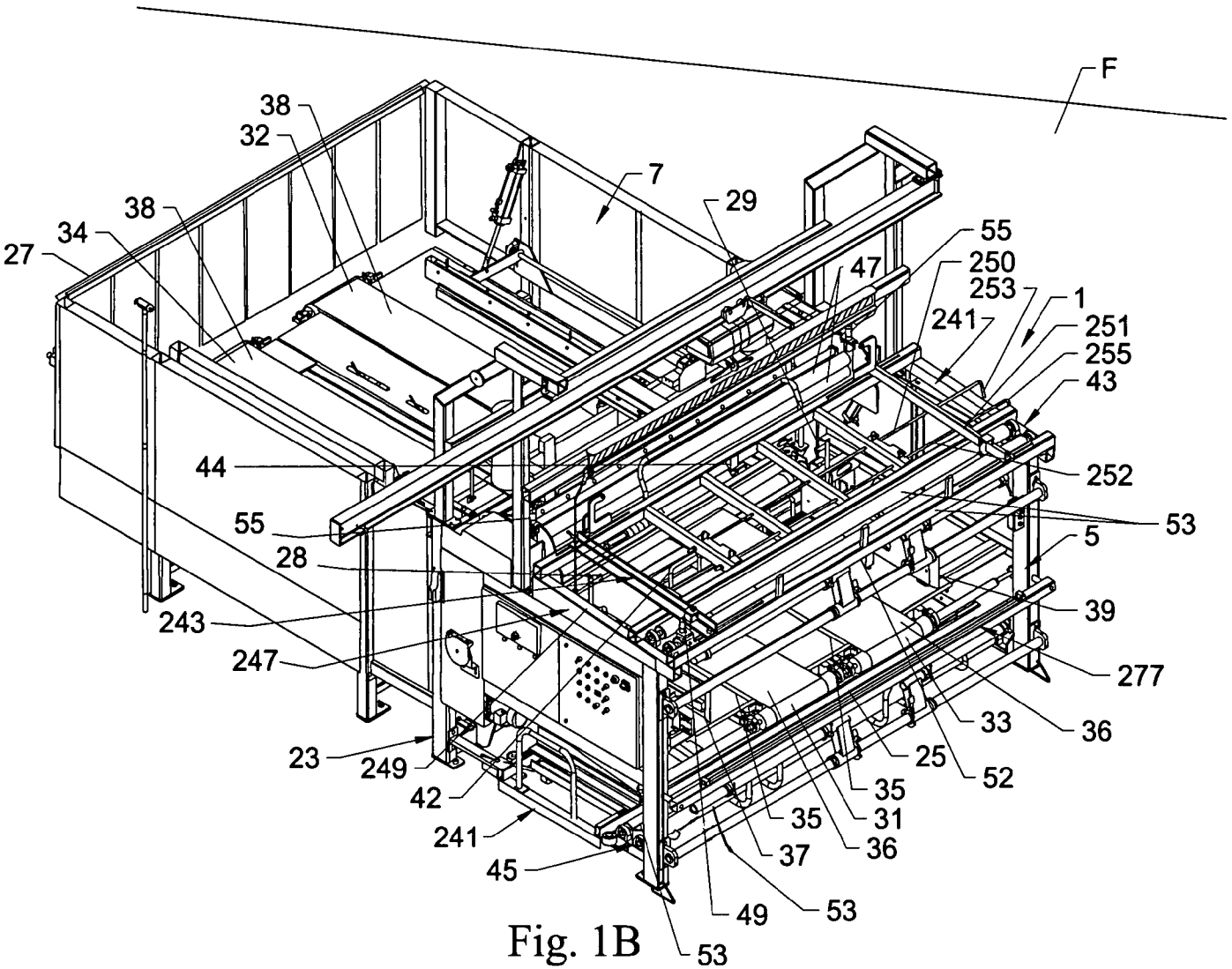
FIG. 1B is a top perspective of the packaging machine.

The product receiving area 5 has at least one and generally two conveyors 31, 33 spaced apart on the frame 23 for receiving an unpackaged product P from the input end 25 and moving the product along a path of travel through the product receiving area. The packaging area 7 similarly can have two conveyors 32, 34 (FIG. 2B) spaced apart on the frame 23 for receiving the product P from the product receiving area 5 and moving the product along a path of travel through the packaging area 7 to the output end 27 of the machine 1. As shown in FIGS. 1A and 1B, the conveyors 31, 33 each comprise a belt 36 moveably mounted on a product receiving surface of the frame 23 and a rail 35 for supporting the belt on the product receiving surface. The rails 35 generally are formed from a low friction material (e.g., UHMW polyethylene) and are positioned between the belt 36 and the product receiving surface of the frame 23 so that the belt is positioned above the product receiving surface by at least approximately ¼ of an inch. The rails 35 raise the belts 36 above the product receiving surface to increase the traction of the belts so that the belts can more readily move products such as foundations or box springs which may be warped or curved so as to not adequately contact the belts if the belts were not raised above the product receiving surface. It is understood that belts 36 may be flush with the product receiving surface or that the belt may be spaced above the product receiving surface by other dimensions without departing from the scope of this invention. In the illustrated embodiment, the conveyors 32, 34 in the packaging area 7 of the machine are of similar construction as the conveyors 31, 33 in the product receiving area 5 of the machine except that the conveyors in the packaging area have belts 38 mounted on the product receiving surface. The belts 38 in the packaging area 7 may be a thicker material that more readily grasps the product P than the belts 36 in the product receiving area 5. The belts 36 in the product receiving area 5 are thinner than the belts 38 in the packaging area 7 to allow the product P to be moved laterally in the product receiving area to properly position the product in the product receiving area. It is understood that the conveyors 31, 33 and 32, 34 may be other types of material moving apparatus having other configurations without departing from the scope of this invention.

Guides 37, 39 generally are provided along a respective side of the mattress receiving area 5, and one of the guides (e.g., the left side guide 37) can be moveable on the frame 23 and the other guide (e.g., the right side guide 39) being mounted on the frame in a fixed position. In the illustrated embodiment, the left side guide 37 is movable toward and away from the right side guide 39 for lateral positioning of the product P in the product receiving area 5 of the machine 1. The moveable guide 37 positions the product P against the other, fixed guide 39 to place it in a proper or desired alignment or orientation for packaging. In the illustrated embodiment, each of the guides 37, 39 is an elongated plate, generally formed from steel or similar material, along which the side edges of the mattress P will pass as the mattress is moved along the path of travel through the product receiving area 5 to the packaging area 7 of the machine 1. The moveable guide 37 has a sensor 28 attached to the guide at a location above the guide and positioned to detect when the moveable guide contacts the product P. The fixed guide 39 has a sensor 29 attached to the guide at a location above the guide and positioned to detect when the product P has been positioned against the fixed guide. In the illustrated embodiment, the sensors 28, 29 are visible light photo sensors that detect when the beam of light is interrupted by the positioning of the product P against or immediately adjacent the guides 37, 39. It will be understood that the sensors 28, 29 could be other types of sensors or detectors without departing from the scope of this invention.

The moveable guide 37 generally is moved toward and away from the fixed guide 39 through the use of a drive mechanism (not shown), such as a servomotor, or pneumatic cylinder that may be operatively connected to the moveable guide and located below the conveyor 31 in the product receiving area 5. A gate 42 (FIG. 1B) is positioned at the downstream end of the product receiving area 5 and is rotated into the path of travel of the product P to stop further movement of the product upon activation by a sensor 44 (FIG. 1B). The sensor 44 is mounted on the frame 23 at a location above the gate 42 and is generally centered between the left and right sides of the machine 1 toward the downstream end of the product receiving area 5. In the illustrated embodiment, the sensor 44 is visible light photo sensor that directs a vertical beam of light at a location approximately one inch in front of the gate 42 to detect when the downstream end D of the product P is loaded in the packaging area 5. The placement of the sensor 44 at a location generally centered between the left and right sides of the machine 1 allows the sensor to detect if the product P is properly aligned in the product receiving area 5 with the downstream end D of the product generally parallel to the gate 42. If the product P is misaligned in the product receiving area 5 such that the downstream end D of the product P is not parallel to the gate 42, the sensor 44 will not recognize that the product has been loaded in the product receiving area and packaging of the product will not continue. Upon detection of the downstream end D of the product P in the product receiving area 5, the sensor 44 also activates the moveable guide 37 which moves laterally across the product receiving area to contact the left side LS of the product P so as to urge the product in the lateral direction against the fixed guide 39. When the moveable guide 37 contacts the mattress P, the sensor 28 on the moveable guide detects that the mattress has been contacted. When the mattress P has been urged against the fixed guide 39, the sensor 29 detects that the mattress P is correctly positioned against the guide 39 in the product receiving area 5 of the machine. To prevent damage to the machine 1 or the mattress P, the drive initiating movement of the moveable side guide 37 is deactivated upon detection by the sensor 29 that the mattress has been stopped from further lateral movement by the fixed side guide 39. In this way, the sensors 28, 29 mounted on respective guides 37, 39 in the product receiving area 5 detect when the proper lateral positioning of the mattress P has been achieved and the sensor 44 located above the gate 42 detects when the proper longitudinal positioning of the mattress has been achieved in the product receiving area. Once the three sensors 28, 29, 44 have detected the correct positioning of the mattress P in the product receiving area 5, the gate 42 is rotated out of the path of travel of the mattress to allow the mattress to pass into the packaging area 7 of the machine 1.

The upper and lower rolls 11, 17 of a packaging material are rotatably received within respective upper and lower cradles, generally indicated a 43, 45, mounted above and below the product receiving area 5 of the packaging machine 1 of the present invention. In the illustrated embodiment each cradle 43, 45 comprises a respective pair of cradle rollers 53 mounted on the frame 23 and spaced apart to receive a respective upper and lower roll 11, 17 therebetween. The cradle rollers 53 are free to spin on the frame and are in contact with the upper and lower roll to allow the respective upper and lower roll 11, 17 to spin in the cradle as packaging material 3 is fed from above and below the product receiving area 5 into the packaging area 7 for application to the product P. The webs 13, 19 of packaging material 3 of each roll 11, 17 generally are a polyethylene or similar plastic film typically approximately 1.25 mil to approximately 4 mil in thickness, although other materials having greater or lesser thicknesses of the packaging material also can be used as will be understood by those skilled in the art. In the illustrated embodiment, one cradle roller 53 of each pair of cradle rollers has a pneumatic brake 49 mounted near an axial end of the roller. The pneumatic brake 49 comprises a brake pad (not shown) mounted to a pneumatic actuator that is pressurized to apply a drag force on the cradle roller 53 during operation of the machine 1. The pneumatic brakes 49 prevent overfeed of the packaging material 3 from the respective upper and lower roll 11, 17 by the application of the drag force to the respective cradle roller 53 that prevents the respective upper and lower roll 11, 17 from turning at a speed greater than the speed required to deliver the upper and lower webs 13, 19 of packaging material. As shown in FIG. 1B, the pneumatic brake 49 is located adjacent the left axial end of the upstream cradle roller 53 of each pair of cradle rollers but it is understood that the pneumatic brake may be otherwise positioned and may be otherwise configured to include other mechanisms for producing the drag force on the cradle roller without departing from the scope of this invention. In one embodiment, the machine 1 has an upper pair of pinch rollers 47 (FIG. 1B) at the top of the product receiving area 5 receiving the upper web therebetween and a lower pair of pinch rollers (not shown) mounted at the bottom of the product receiving area and receiving the lower web 19 therebetween. Each of the pinch rollers can be covered by a friction increasing material (e.g., neoprene) for frictional attachment of each of the webs 13, 19 between the respective pair of pinch rollers. At least one of each pair of pinch rollers is driven by a motor (not shown) so the webs 13, 19 of material are pulled by the pinch rollers and delivered from the respective upper and lower roll 11, 17 of packaging material to the packaging area 7 of the machine. In the illustrated embodiment, one pinch roller of each pair of pinch rollers 47 has a lifting mechanism (broadly "pinch roller adjustment mechanism") 55 mounted on the top roller of each pair of rollers near each axial end of the roller. The lifting mechanism 55 allows the top roller of each pair of pinch rollers 47 to be lifted at least about ¼ inch above the bottom roller to allow adequate space to readily feed the upper and lower webs 13, 19 of packaging material 3 between the pinch rollers. The lifting mechanism 55 may be actuated by the operator to automatically lift the upper pinch roller 47 to increase the space between the upper and lower pinch rollers when a roll of material 11, 17 is empty or when the upper or lower web 13, 19 of packaging material must be positioned to remove a fold or pleat from the web. It is understood that the pinch rollers 47 may have other configurations without departing from the scope of this invention.

Figure 3:
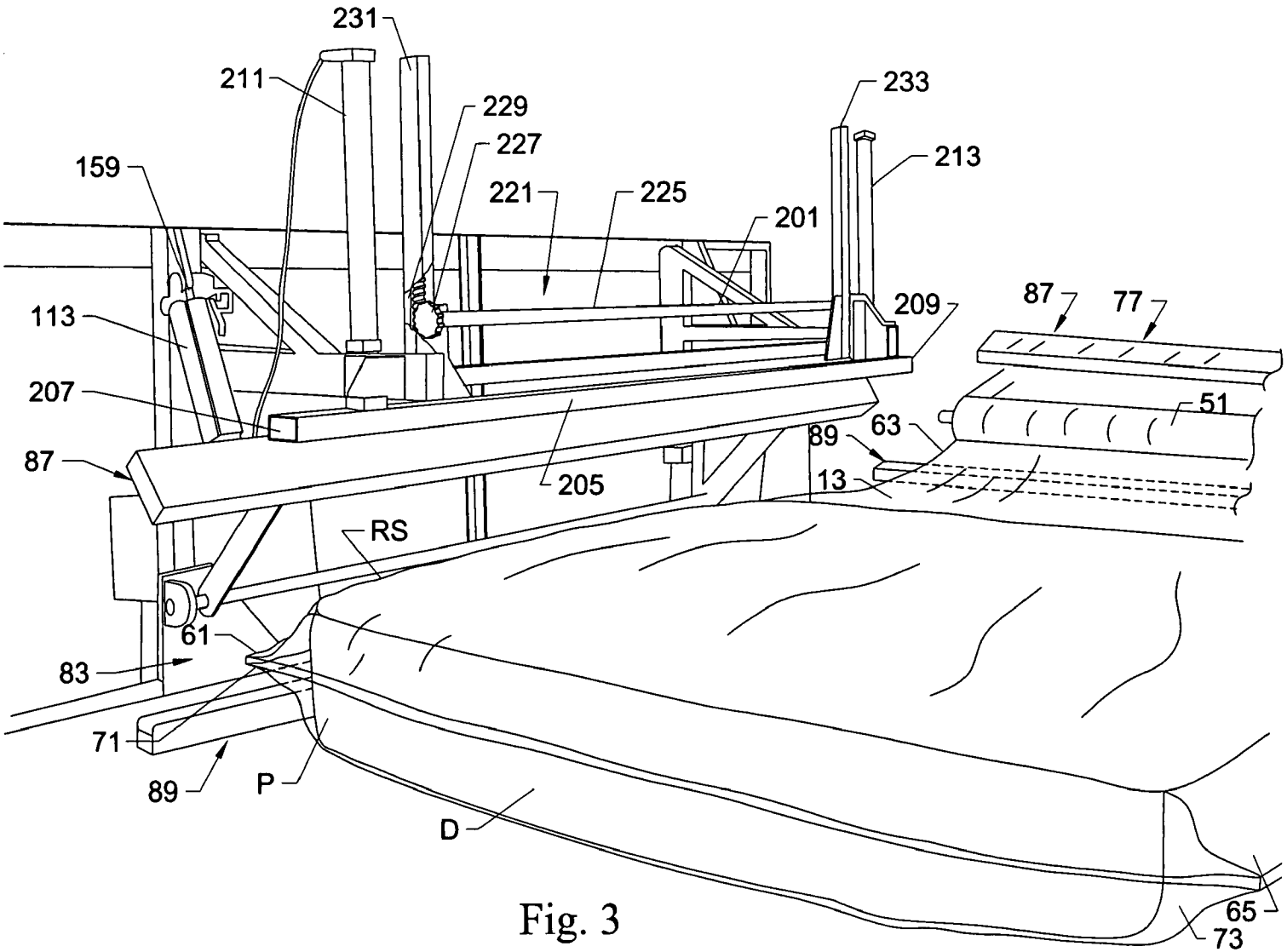
FIG. 3 is an enlarged partial perspective of the packaging area showing a product loaded in the machine.
Figure 4:
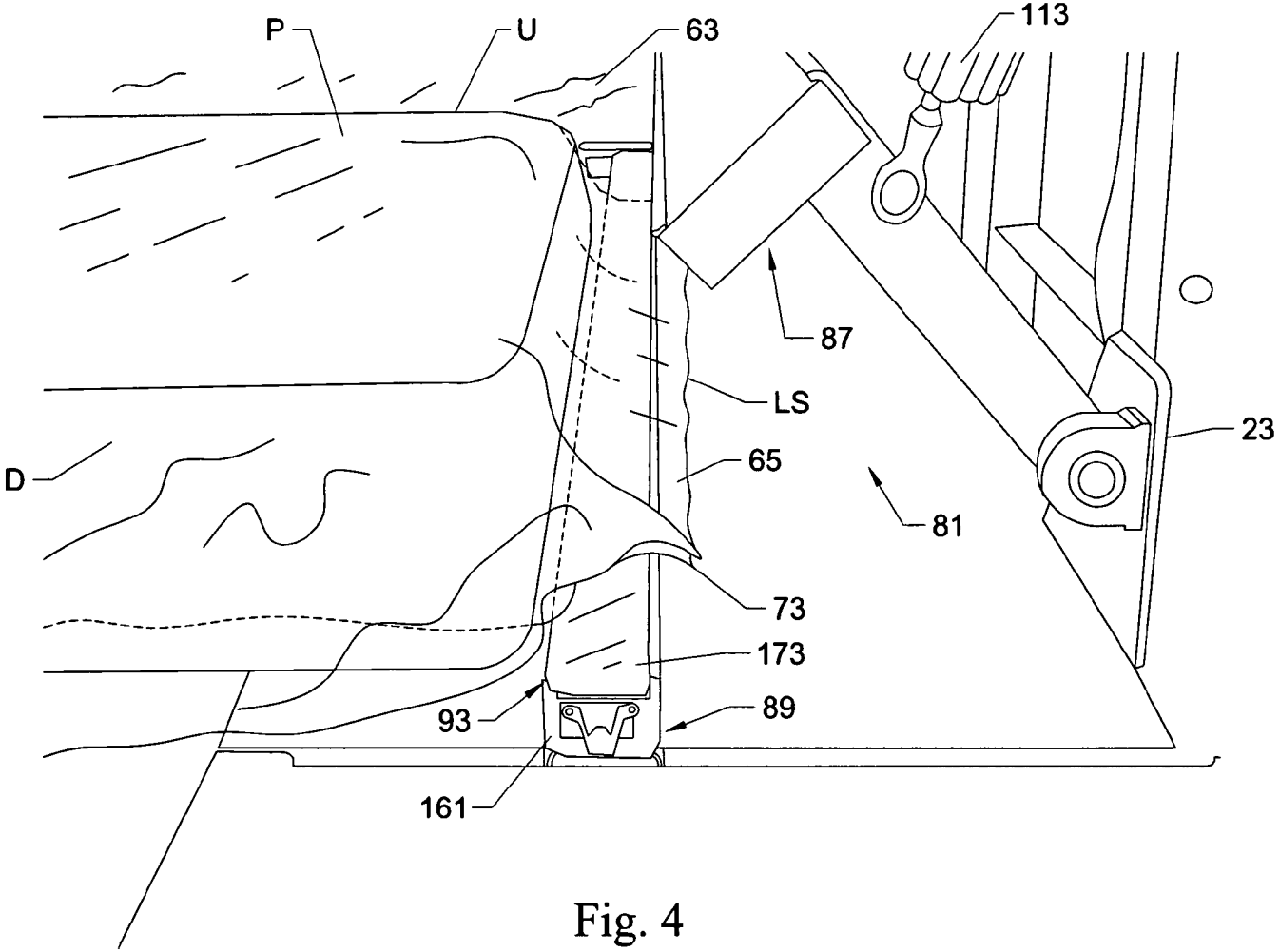
FIG. 4 is an enlarged partial perspective showing an upper and lower sealing assembly of the machine.

As partially illustrated in FIG. 3, a tension roller 51 typically will be positioned above the surface of the mattress P and will be moveable into engagement with the upper surface of the mattress as the mattress is moved through the packaging area 7 and packaged in the machine 1. A pivot mechanism, such as one or more pneumatic cylinders (not shown) generally are attached to the tension roller 51, with the tension roller generally being an idler roller that rolls over the upper surface of the mattress P as the mattress moves thereunder. The tension roller 51 is moved into engagement with and presses the plastic packaging material 3 against the upper surface of the mattress P as the mattress is pushed through the packaging material so as to substantially reduce the amount of slack in the plastic packaging material and ensure an essentially tight, compact package.

As discussed in more detail below, the upper and lower webs 13, 19 are bonded together at the upstream end of the packaging area 7 prior to the entry of the mattress P into the packaging area. When the mattress P is moved into the packaging area 7 by the packaging area conveyors 32, 34, the drive roller of each pair of upper and lower pinch rollers 47 is activated so that the webs 13, 19 of material are fed and pulled into the packaging area 7 as the mattress is moved along the path of travel so that the upper web 13 of material covers the top of the mattress P while the bottom web 19 of material covers the bottom of the mattress. At the entrance to the packaging area 7 the upper and lower webs 13, 19 are joined so that the downstream end D of the mattress P presses against the bonded upper and lower webs as the product moves along the path of travel in the packaging area 7. Air jets can be positioned along the side of the path of travel in the packaging area 7 to direct flows of air under pressure along the left side LS of the mattress and the right side RS of the mattress to separate and keep the webs 13, 19 of packaging material from clinging to the mattress or being caught or pulled prior to sealing. When the mattress P is fully advanced into the packaging area 7, each of the upper and lower webs 13, 19 of packaging material typically has a marginal or edge portion that extends from the upstream end U and sides LS, RS of the mattress P. As shown in FIG. 3, the upper web 13 has a right side marginal portion 61, an upstream marginal portion 63, and a left side marginal portion 65, while the bottom web 19 has a right side marginal portion 71 and a left side marginal portion 73 with the upstream marginal portion being hidden from view.

In the illustrated embodiment, the packaging machine 1 includes an end sealing assembly, generally designated at 77 (FIGS. 2A-2B), and positioned at the upstream end of the packaging area 7 for sealing the marginal portions 63 of the webs 13, 19 at the upstream end U of the mattress P, a left side sealing assembly, generally designated at 81, positioned at the left side of the packaging area for sealing the marginal portions 65, 73 of the webs at the left side LS of the mattress, and a right side sealing assembly, generally designated at 83, positioned at the right side of the packaging area for sealing the marginal portions 61, 71 of the webs at the right side RS of the mattress. In the illustrated embodiment, the end sealing assembly 77 and the left and right side sealing assemblies 81, 83 each include an upper sealing assembly, generally designated 87, moveably mounted on the frame 23 and a lower sealing assembly, generally designated 89, positioned for cooperative engagement with the upper sealing assembly. The upper and lower sealing assemblies 87, 89 have respective upper and lower sealing elements 91, 93 for the application of heat to the respective marginal portions of the upper and lower webs 13, 19 of packaging material to form a thermal bond (seal) between the upper and lower webs around the respective downstream side D, upstream side U, left side LS, and right sides RS of the mattress P. In this way, a seal is formed at each of the four sides of the mattress P so that the mattress is enclosed in the packaging material 3 and sealed in a protective environment.

After the mattress P is fully advanced into the packaging area 7, the end sealing assembly 77 is operated to form a thermal bond between the upper and lower webs 13, 19 of packaging material that forms the seal at the upstream end U of the mattress that is received in the packaging area. In the illustrated embodiment, the end sealing assembly 77 also cuts the upper and lower webs 13, 19 of material and forms a second thermal bond between the upper and lower webs that serves as the seal that connects the upper and lower webs at the inlet of the packaging area 7 which forms the seal at the downstream end D of the next mattress to be packaged in the machine 1. In this way, the end sealing assembly 77 simultaneously forms the thermal bond at the upstream end U of the mattress P loaded in the packaging area and the thermal bond at the downstream end D of the next mattress to be packaged in the machine 1. As will be discussed in more detail below the end sealing assembly 77 applies heat to the first and second webs 13, 19 of heat bondable packaging material 3 so as to bond the webs of packaging material together along a heat-sealed seam. Thereafter, the left side sealing assembly 81 and the right side sealing assembly 83 may be operated simultaneously in a similar fashion to form the heat-sealed edge along the respective left and right sides LS, RS of the mattress P. It is understood that the left side sealing assembly 81 and the right side sealing assembly 83 could be operated sequentially without departing from the scope of this invention. Any excess material of the upper and lower webs 13, 19 of packaging material on the outer periphery of the left and right heat sealed edges may be cut away and discarded. The completed, packaged mattress P then is passed out of the packaging machine 1 of the present invention through the output end 27 thereof for storage and transport.

Figure 2A:
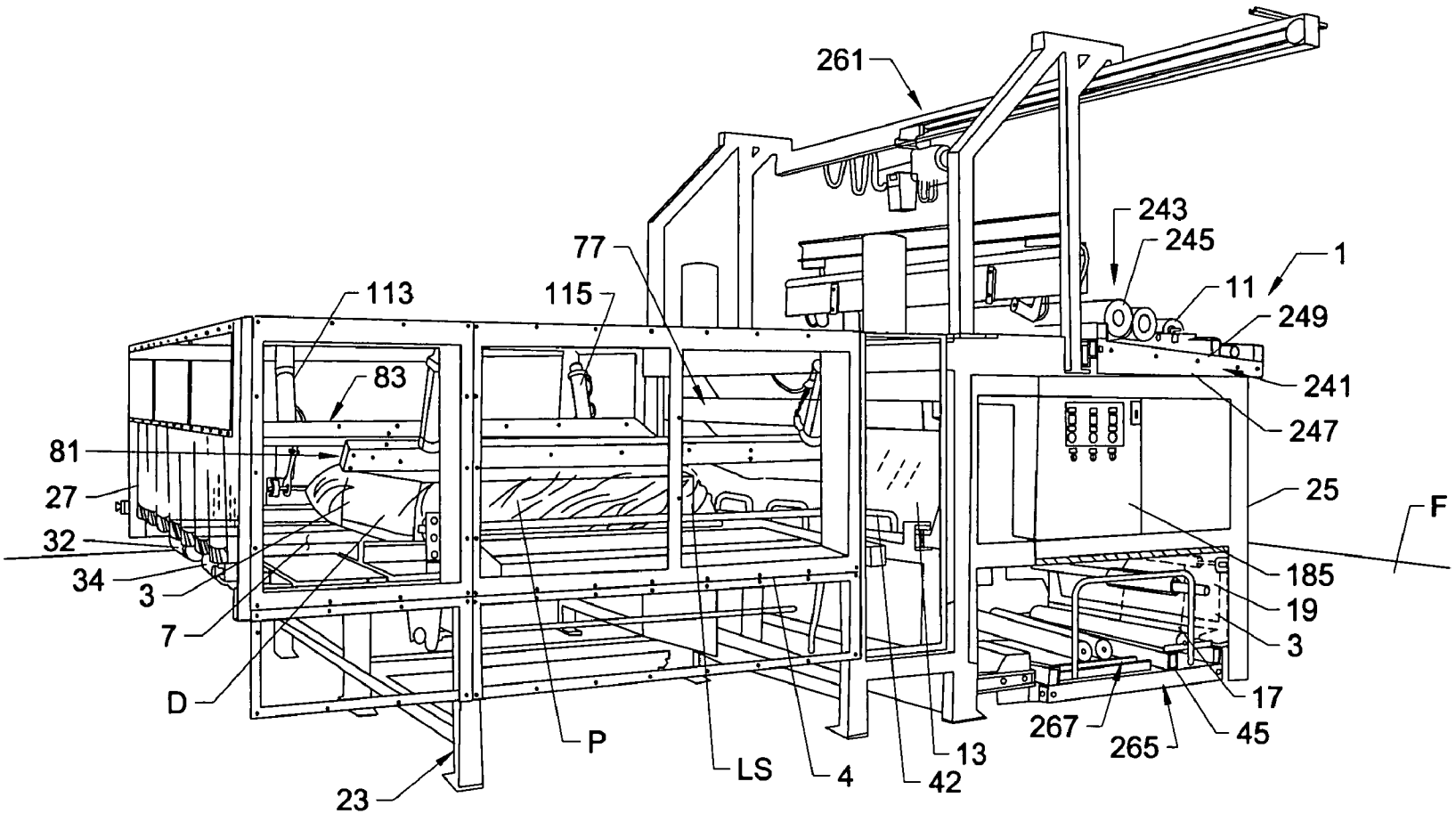
FIG. 2A is a rear perspective of the packaging machine.
Figure 2B:
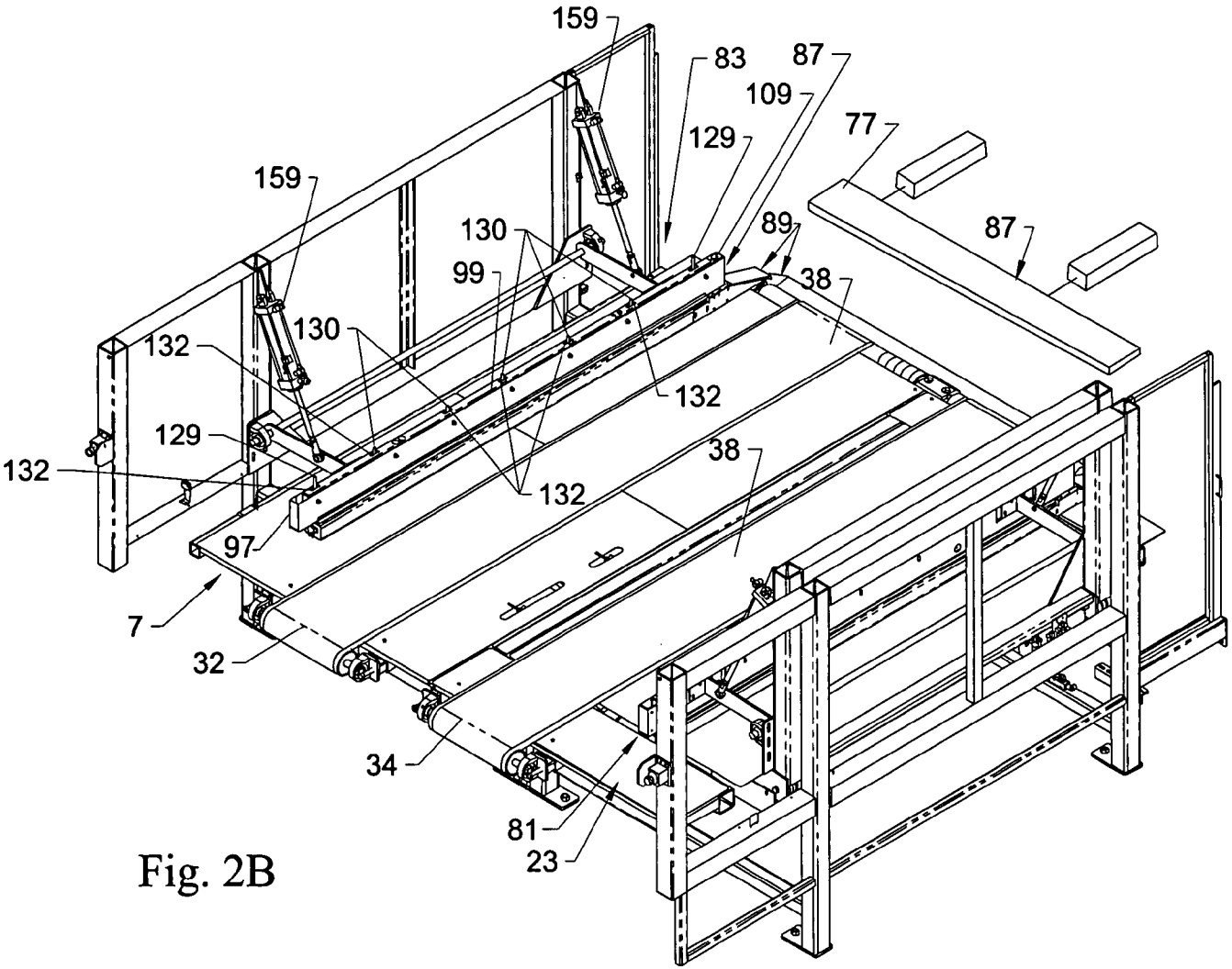
FIG. 2B is a partial perspective of the packaging machine showing a packaging area of the machine.
Figure 6:
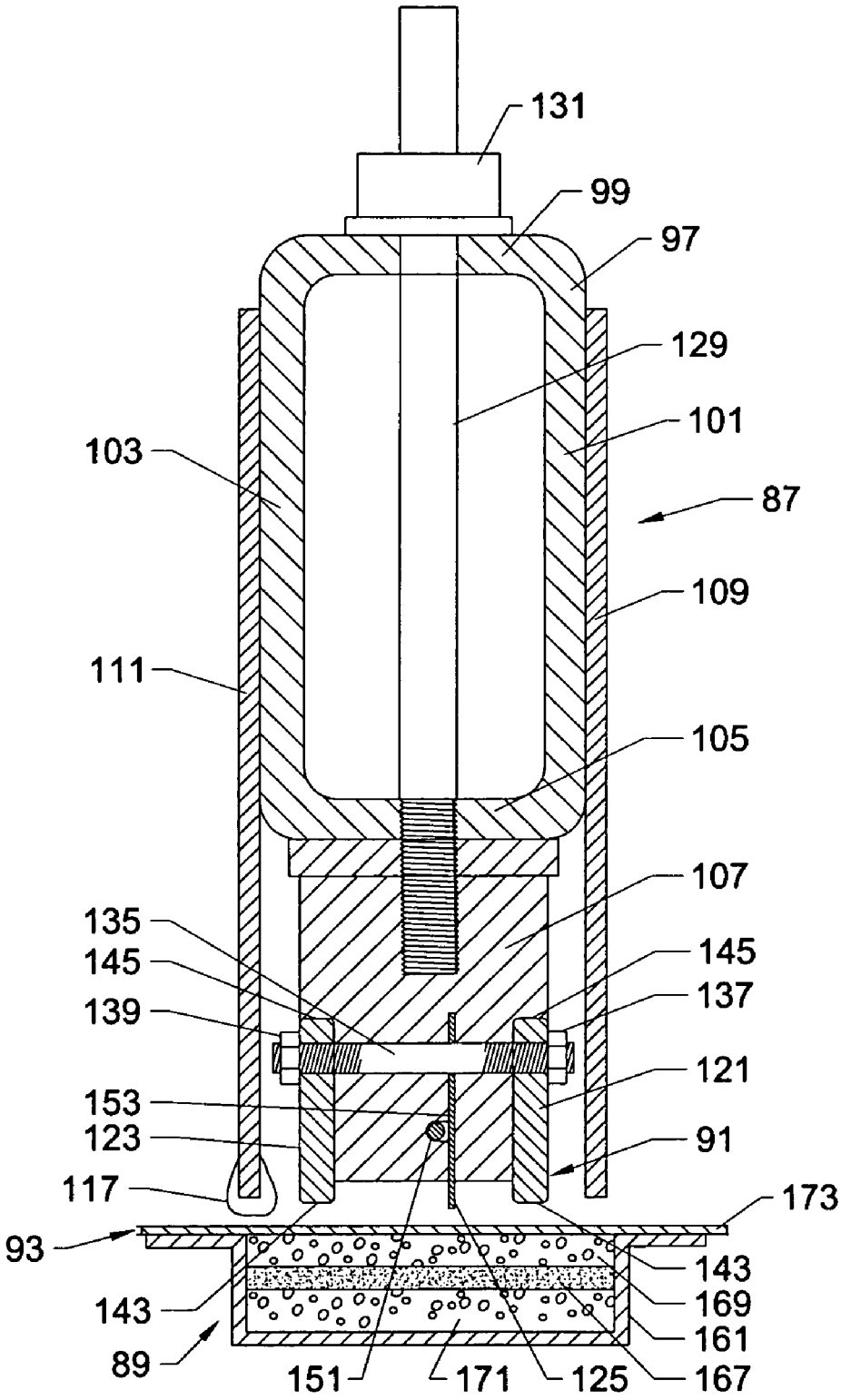
FIG. 6 is a partial cross-section of the upper and lower sealing assembly.

The upper sealing assembly 87 and lower sealing assembly 89 of the end sealing assembly 77 are shown in FIG. 6 and described herein but it is understood that the upper and lower sealing assemblies of the left side sealing assembly 81 and the right side sealing assembly 83 may be substantially similar. As shown in FIG. 6, the upper sealing assembly 87 comprises a tubular support 97 moveably mounted on the frame 23 having a top wall 99, two side walls 101, 103 and a bottom wall 105, a mounting bracket 107 attached to the bottom wall of the support, and two guards 109, 111 in the form of elongate plates attached to respective side walls of the support. The upper sealing assembly 87 is moveable from the raised position (FIG. 3) to the actuated position by two air cylinders 113, 115 (only one of which is shown in FIG. 3) mounted adjacent to respective ends of the sealing assembly. In the illustrated embodiment, the inwardly located guard 111 has a shield 117 on the lower edge of the guard and extending lengthwise thereof. The shield 117 may be made from silicon or other suitable material that protects the edge of the guard 111 and prevents adhesion of the packaging material 3 to the guard. The mounting bracket 107 generally comprises an elongated bar or block formed from aluminum, steel, or similar durable, high strength material, and typically will be Teflon coated to resist fouling or the collection of plastic thereon. Alternatively, the shield 117 may be replaced with a bend at the lowermost edge of the inwardly located guard 111 that provides a blunt, rounded surface that flattens and clamps the packaging material 3 at the sides of the upper sealing assembly 87 adjacent to the mattress P prior to sealing by the upper and lower sealing assemblies 87, 89. The mounting bracket 107 generally will be notched to form recesses or cavities in which the upper sealing elements 91 such as seal bars 121, 123 and cutting blade 125 of the sealing assembly 87 can easily be located and mounted for ease of repair and replacement. The mounting bracket 107 is attached to the support 97 by a plurality of threaded rods 129 including longer rods 129 and shorter rods 130 extending through the top and bottom walls 99, 105 of the support into the mounting bracket and a nut 131 attached to the threaded rod 129 at the top wall of the support. As shown in FIG. 2B, the two rods located adjacent respective longitudinal ends of the sealing assembly 87 are the longer rods 129 and the remaining rods spaced apart between the two end rods are the shorter rods 130. Each rod 129, 130 is received in a slot 132 in the top wall 99 of the support 97 and a slot (not shown) in the bottom wall 105 of the support to accommodate the different thermal expansion between the mounting bracket 107 (which is typically aluminum) and the support (which is typically steel). The slots 132 allow the rods 129, 130 to move with the mounting bracket 107 that expands as a result of thermal expansion a greater amount than the support 97.

Figure 7:
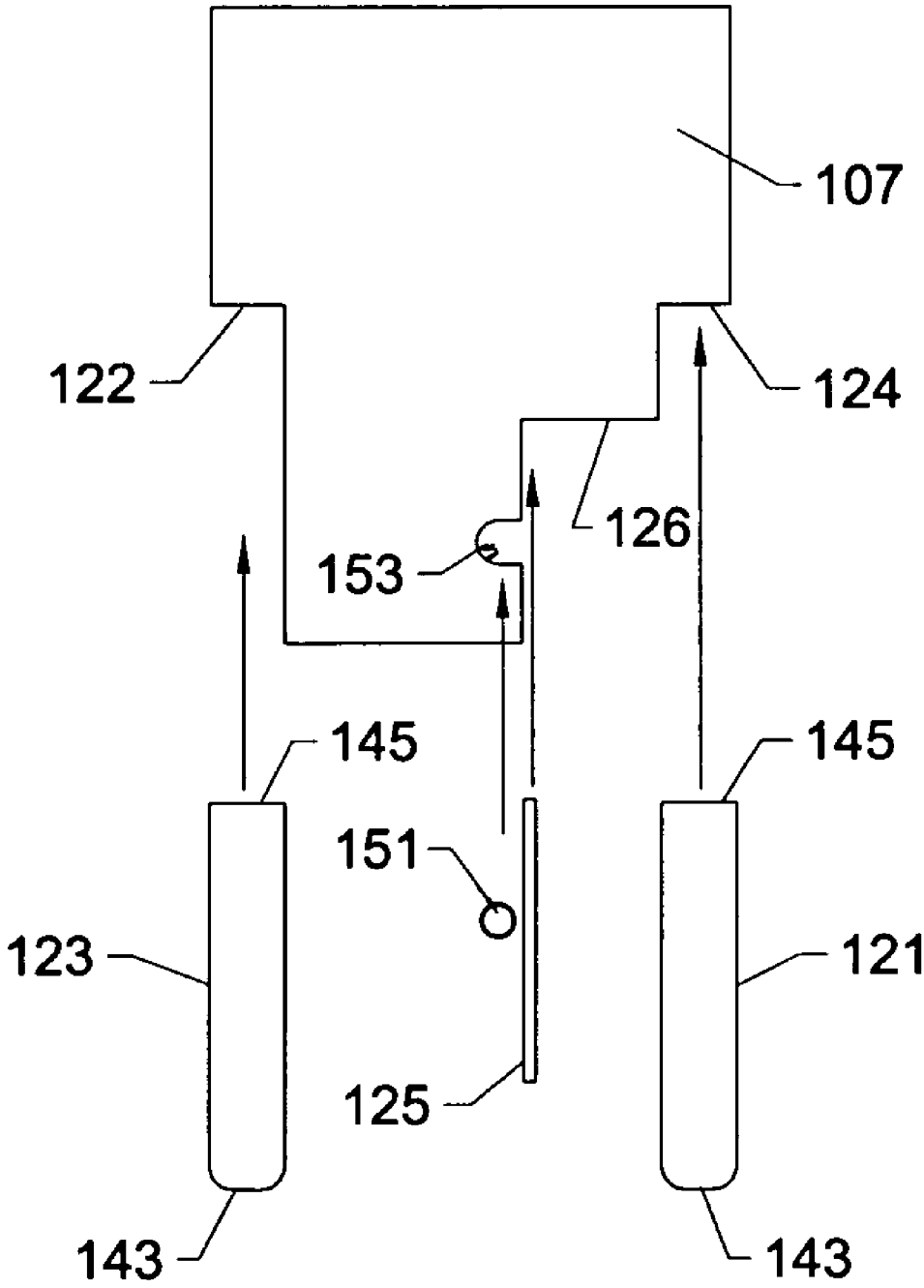
FIG. 7 is a partial exploded schematic of the upper sealing assembly.

As shown in FIGS. 6 and 7, the two seal bars 121, 123 and cutting blade 125 are received in a respective notch in the mounting bracket 107 and are attached to the mounting bracket by a threaded fastener 135 (FIG. 6) and a respective nut 137, 139 attached to the ends of the fastener adjacent the seal bars. In one embodiment, the seal bars 121, 123 are attached to the mounting bracket 107 at spaced apart locations and the cutting blade 125 is attached to the mounting bracket at a position between the seal bars. It is understood that the seal bars 121, 123 and cutting blade 125 could be otherwise positioned or that more or less than two seal bars and more or less than one cutting blade may be attached to the mounting bracket 107 without departing from the scope of this invention.

The seal bars 121, 123 each have a first sealing surface 143 along the exposed longitudinal edge of the seal bar and a second sealing surface 145 along the opposite longitudinal edge of the seal bar that is received in the mounting bracket. In the illustrated embodiment each seal bar 121, 123 is reversibly mounted on the mounting bracket 107 so that each seal bar may be removed from the position shown in FIG. 6 and reattached to the mounting bracket so that the second sealing surface 145 is exposed for engaging the packaging material 3. In the illustrated embodiment, should the first sealing surface 143 of the seal bar 121, 123 become fouled or otherwise corrupted with packaging material 3, the seal bar can be quickly and easily reversed to expose the second sealing surface 145 for use in sealing the packaging material. It is understood that the seal bars 121, 123 and the cutting blade 125 each comprise a nonstick material to prevent adhesion of the packaging material 3 to the respective element. In the illustrated embodiment, the seal bars 121, 123 and cutting blade 125 have a non-stick coating, typically a fluoropolymer, for example, a polytetrafluoroethylene (PTFE) material such as Teflon® applied by conventional material deposition techniques to the outer surfaces of the seal bars and cutting blade but it is understood that the seal bars and cutting blade may have other nonstick materials applied by other methods such as a Teflon tape applied to the external surface of each of the seal bars and the blade.

A heating element 151 of an electrical resistance heater is received in a notch 153 in the mounting bracket 107 generally adjacent the cutting blade 125. The heating element 151 heats the mounting bracket 107, cutting blade 125, and the seal bars 121, 123 of the upper sealing assembly 87 so that heat is delivered to the upper and lower webs 13, 19 of packaging material 3 when the upper sealing assembly is moved to the actuated position. One suitable heater for use in the upper sealing assembly is an electric resistance seal bar heater available from Watlow Electric Manufacturing Company of St. Louis, Mo., but it is understood that other types of heaters may be used without departing from the scope of this invention.

Figure 8:
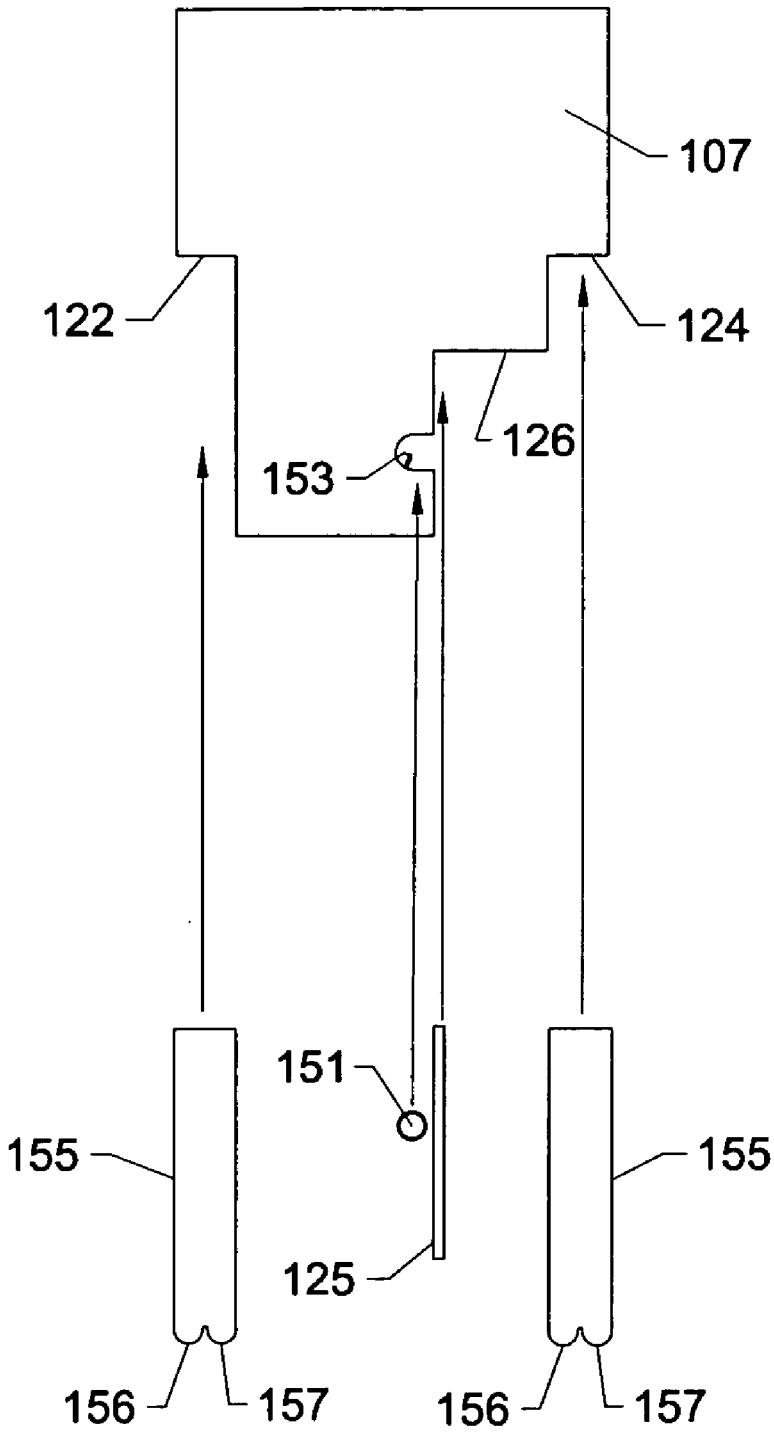
FIG. 8 is a partial exploded schematic of the upper sealing assembly of a second embodiment of the invention.

The upper sealing assembly 87 of the present invention may have a variety of different configurations which are designed to provide varying types of seals, as well as providing varying arrangements that enable quick and easy repair or replacement of the seal bar(s) 121, 123 and/or cutting blade 125 without requiring expensive measurements and gauges to reset or rebuild the upper sealing assemblies, and without requiring substantial replacement of the entire upper sealing assembly. For example, the upper sealing assemblies 87 of the present invention can include a pair of seal bars 121, 123 with a first and second sealing surface 143, 145 and with the cutting blade 125 therebetween, a pair of seal bars with a single sealing edge design and a cutting blade therebetween, one or more seal bars with or without the cutting blade, and various other configurations of single and double sealing edge seal bars. Further it is understood that the seal bars and cutting blades may be Teflon coated or wrapped with high temperature Teflon tape to resist buildup or collection of melted plastic thereon. As shown in FIG. 8, the upper sealing assembly 87 may include seal bars 155 having a sealing edge with two lips 156, 157 so that each seal bar forms two spaced apart seals in the corresponding edge margins of the packaging material. It is understood that the dual lip sealing edge design of the seal bars 155 could also include corresponding dual lips on the opposite longitudinal sealing surface of the seal bars without departing from the scope of this invention. In addition, the cutting blade 125 can be notched as needed or desired to form a perforated cut in the plastic packaging material 3.

The upper sealing assembly 87 is assembled using the various seal bar configurations such as discussed above. The seal bars 121, 123 are placed within the mounting bracket 107, with the knife or cutting blade 125 further being mounted within its notch or guide slot, after which the seal bars and cutting blade typically are secured with the series of laterally extending mounting bolts 135. As indicated, the mounting bracket 107 of each assembly 87 then generally will be attached via the self-threaded mounting stud 129 to the elongated support 97. The pair of guards 109, 111 are attached to the support member 97 extending downwardly adjacent the seal bars 121, 123 and being spaced outwardly therefrom. One or each of the guards 109, 111 can include the shield 117 clamped to the edge thereof so as to cushion and seal the packaging material 3 against the lower seal assembly 89.

The air cylinders 113, 115 of the upper sealing assembly each have a brake mechanism 159 (FIG. 3) in the form of a lockout valve or check valve mounted on the cylinder to prevent the flow of air from the cylinder when the air supply to the machine 1 is turned off. When the upper sealing assemblies 87 are raised, each cylinder 113, 115 is pressurized and filled with air and when the packaging machine 1 is turned off, the lockout valve prevents the air in each cylinder from leaking and the air cylinder pressure from reducing to a level where the upper sealing assembly is lowered. Without the lockout valves, when the power is turned off, the compressed air in the cylinders would leak over time and the upper sealing assemblies 87 would drop when the air pressure in the cylinders is reduced to a pressure that no longer maintains the upper sealing assembly in the raised position.

Figure 5:
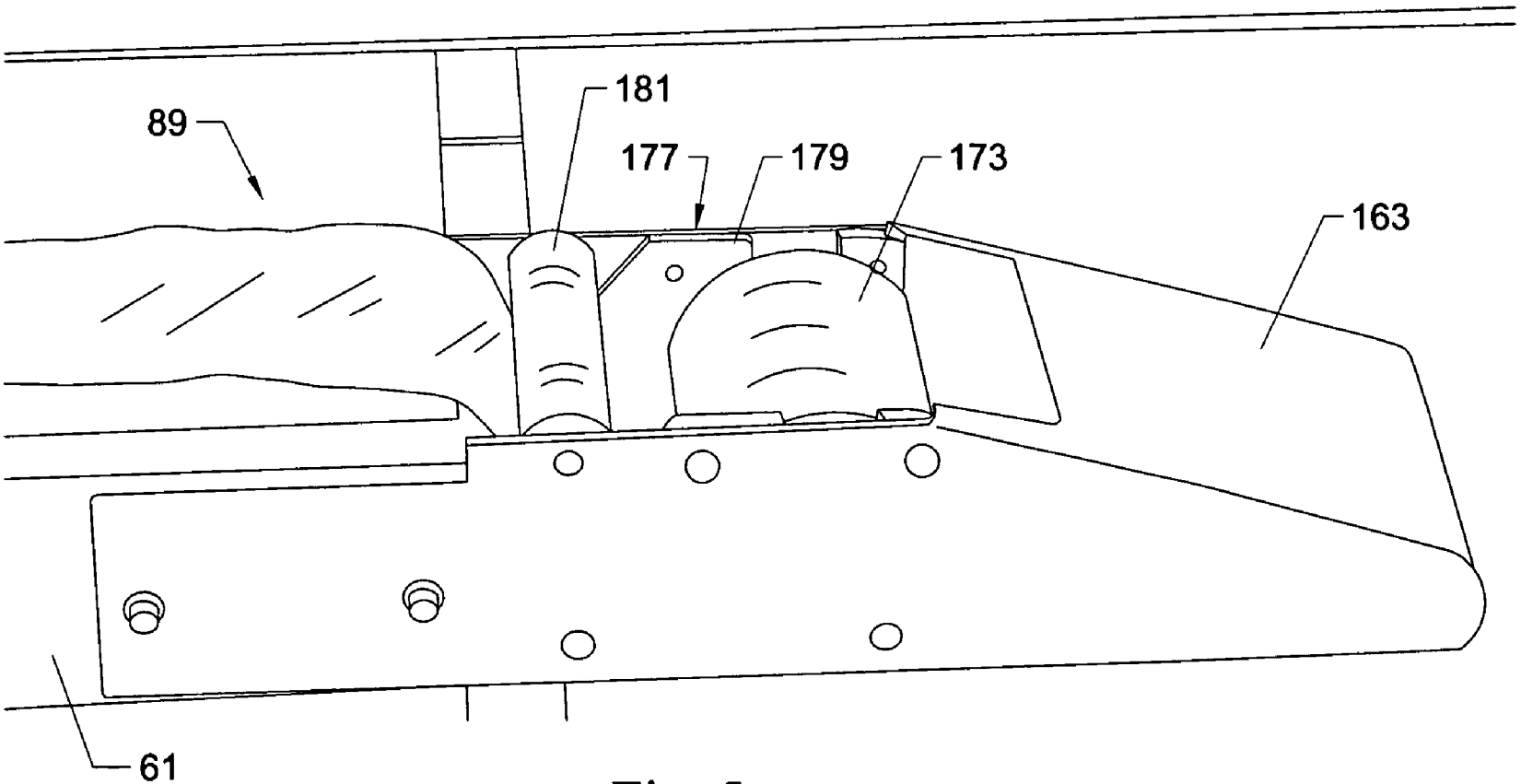
FIG. 5 is an enlarged partial perspective of the lower sealing assembly.

As shown in FIG. 6, the lower sealing assembly 89 is positioned beneath upper sealing assembly 87 for each of the end and side sealing assemblies 77, 81, 83 and generally will include a support 161 in the form of a trough mounted on the frame 23 of the machine 1. As shown in FIG. 5, the support includes in inclined surface 163 for receiving the marginal edges of the upper and lower webs 13, 19 of packaging material 3 as the mattress P advances in the packaging area 7 so that the edges are raised above the support surface of the mattress for sealing by the upper and lower sealing assemblies 87, 89. Each lower sealing assembly 89 typically will include a silicon sponge or other insulating material, which can be applied in layers with a silicon layer 167 in between a pair of silicon sponge layers 169, 171 with the lower sealing element 93 applied over the upper layer of the sponge material and extending across the top of the support 161. In the illustrated embodiment, the lower sealing element 93 includes a replaceable heat resistant roll 173 of nonstick tape such as Teflon tape or similar non-stick material that is applied over the length of the support 161. The Teflon tape 173 has an adhesive layer on its lower surface for secure attachment of the tape to the support 161 and the upper layer 169 of the sponge. As shown in FIG. 5, the support 161 includes a tape dispenser, generally indicated at 177, at one end of the support that includes a holder 179 for holding the replaceable roll 173 of Teflon tape and a roller 181 mounted on the holder for dispensing the tape. When the upper sealing assembly 87 is moved to the actuated position, the seal bars 121, 123 will bear against this nonstick surface of the tape 173, engaging the packaging material 3 therebetween to form the heat sealed seams between the edges of the webs 13, 19 of packaging material along the sides and ends of the mattresses P.

The machine 1 generally includes a control mechanism including a control panel, generally indicated 185, for controlling and monitoring the operation of the machine and the heating elements 151 in the sealing assemblies 87. The heating elements 151 heat the seal bars 121, 123 and cutting elements 125 of the upper sealing assembly 87 so that as the seal bars are pressed into contact with the plastic sheeting material 3, the webs 13, 19 of the plastic sheeting material will melt and become sealed together to thus form a seam between the plies of the material, and close the open side edges of the packaging material about the mattress P being packaged.

To repair or replace the seal bars 121, 123 and/or cutting blades 125 of each of the upper sealing assemblies 87 of the packaging machine 1 of the present invention, an operator will first remove the lock nuts 131 (FIG. 6) of shorter mounting studs 130 (FIG. 2B) along the top wall 99 of the upper sealing assembly support 97. Next, the lock nuts 131 on the longer locking studs 129 are loosened so as to enable the mounting brackets 107 (FIG. 6) to drop down below the lower surfaces of the guards 109, 111 to allow access to the seal bars 121, 123 and/or cutting blades 125. In one embodiment, the mounting brackets 107 are lowered approximately 1½ inches from the mounted position shown in FIG. 6 or an otherwise sufficient amount until the seal bar mounting bolts 135 are exposed and can be removed. Thereafter, new seal bars 121, 123 and/or a new cutting blade 125 can be placed within the notches or cutouts of the mounting bracket 107 or the seal bars and/or cutting blades can be reversed if they have dual sealing or cutting edges. The mounting bolts 135 will be reinstalled therethrough to lock the seal bars 121, 123 and cutting blade 125 in place on the mounting bracket 107. Thereafter, the lock nuts 131 on the longer mounting studs 129 are retightened until the mounting bracket 107 is drawn up tightly against the bottom wall 105 of the support 97, after which the locking nuts on the shorter locking studs 130 will be applied and tightened, although there typically will be some space left for expansion and contraction between the components.

In one embodiment, the packaging machine 1 includes a right side compression assembly, generally indicated at 201, and a left side compression assembly (not shown) for compressing a respective right and left side RS, LS of the mattress P prior to operation of the right and left side sealing assemblies 83, 81. As shown in FIG. 3, each compression assembly (the right side compression assembly 201 being shown in FIG. 3) includes a compression bar 205 with opposite ends 207, 209 that is moveably mounted on the frame 23 and a first and second actuator 211, 213 in the form of air cylinders respectively positioned adjacent opposite ends of the compression bar. Alternatively, the compression assembly 201 may include a single actuator mounted adjacent either end of the compression bar 205 or a single actuator mounted at the middle of the compression bar without departing from the scope of this invention.

In the illustrated embodiment, the compression assembly 201 includes a synchronizing mechanism, generally indicated 221 for synchronizing the movement of the compression bar 205 so that the opposite ends 207, 209 of the compression bar move from a raised, non-actuated position (FIG. 3) to a lowered, actuated position at a substantially equal speed. The synchronizing mechanism 221 includes a shaft 225 mounted along the compression bar 205, a first gear 227 mounted on a first end of the shaft 225, a second gear (not shown) mounted on a second end of the shaft, and a first rack 229 and a second rack (not shown) mounted at respective ends 207, 209 of the compression bar 205. The first gear 227 engages the first rack 229, while the second gear similarly engages its second rack so that the respective engagement of the first and second gears with the first and second racks synchronizes the vertical movement of the ends 207, 209 of the compression bar 205 when the air cylinders 211, 213 are actuated to move the compression bar. The first gear 227 and first rack 229 are housed in a first housing 231 mounted adjacent the first cylinder 211 and the second gear and second rack are housed in a first second housing 233 mounted adjacent the second cylinder 213. The first gear 227 moves the first end of the shaft 225 along the first rack 229 and the second gear moves the second end of the shaft along the second rack so that the ends of the shaft (and the ends 207, 209 of the compression bar 205) are maintained at the same elevation during the vertical movement of the compression bar. The synchronizing mechanism 221 synchronizes the movement of the compression bar 205 so that the compression bar remains substantially parallel to the upper surface of the product P during movement between the non-actuated position and the actuated position. It is understood that the synchronizing mechanism 221 may have other configurations without departing from the scope of this invention.

In one embodiment, each compression assembly 201 of the machine 1 may be operated in either a low pressure mode or a high pressure mode. In the high pressure mode, the air supplied to the actuators 211, 213 is routed through a first air pressure regulator (not shown) that is set at a high pressure setting (e.g., about 60 psi) to supply compressed air to the actuators at a pressure resulting in the application of the desired amount of compression force by the compression bars 205 contacting the product P during operation in the high pressure mode. In the low pressure mode, the air supplied to the actuators 211, 213 is routed through a second air pressure regulator (not shown) that is set at a low pressure setting (e.g., about 30 psi) to supply compressed air to the actuators at a pressure resulting in the application of the desired amount of compression force by the compression bar 205 contacting the product P during operation in the low pressure mode. It is understood that operation of the compression assemblies 201 in the high pressure mode may be suitable for harder products P (e.g., a firm mattress, foundation, box spring, etc.) and the operation of the compression assemblies in the low pressure mode may be suitable for softer products (e.g., a softer mattress or a pillow top mattress). The selection of the high pressure mode or the low pressure mode of operation of the compression assemblies 201 may be made by the operator at the control panel 185 of the machine 1. Further, the compression assemblies 201 may be turned off at the control panel 185 so that the product P is packaged in the machine 1 without the operation of the compression assemblies. It is further understood that the compression assemblies 201 may be operated in a distance mode wherein each of the compression assemblies of the machine 1 compresses the product P by a set amount or distance. In the distance mode, sensors (e.g., optical sensors, not shown) may be used to detect when the compression bar 205 contacts the top of the product P and to detect when the compression bar has been moved down a preset distance (e.g., about 2 inches) after contacting the top of the product so that the product is compressed by a preset amount of compression. The control panel 185 may include switches to allow an operator to select the between the low pressure mode, high pressure mode, distance mode, or to turn off the operation of the compression assemblies 201.

The packaging machine 1 of the present invention further can include an upper roll replacement system, generally indicated at 241, for replacing the upper roll 11 of packaging material 3 that is located on the top of the packaging machine. The upper roll replacement system 241 includes a storage area, generally indicated at 243, for storing replacement rolls 245 of packaging material in a stored position generally adjacent the roll 11 of packaging material that is mounted in the cradle 43 for supplying the upper web 13 of packaging material to the machine 1. The upper roll replacement system 241 includes a gravity feed mechanism, generally indicated at 247, comprising an inclined support 249 and guide track 251 (FIG. 1B) for supporting the replacement rolls 245 in the storage area 243. The upper roll replacement system 241 has two gates 250, 252 (FIG. 1B) that are operable to allow movement of one of the replacement rolls 245 from the stored position to the loaded position after removal of a spent roll from the machine 1. A first handle 253 and a second handle 255 on the side of the machine 1 actuate a respective one of the gates to allow a replacement roll 245 to move down the inclined support 249 into the loaded position where the replacement roll becomes the upper roll 11 of packaging material 3 that is supported by two idler rollers in the cradle 43 to supply the upper web 13 of packaging material 3. The first handle 255 enables the release of the roll 11 and, after release, the handle is placed back into a locking position that prevents removal of the roll 11 from the cradle 43. The second handle 253 can then be manipulated to allow the replacement roll 245 adjacent the cradle 43 to roll forward to a pre-loading position. The second handle 253 is then used to manipulate the respective gate to lock the next roll in place. Each roll 245, 11 contains a cardboard core that is simply discarded when the roll runs empty. It is understood that a typical roll 245, 11 of packaging material 3 may weigh approximately 400 pounds. As shown in FIGS. 1A and 1B, the packaging machine 1 can include or utilize an overhead crane system, generally indicated at 261, either as part of the machine or as existing in the facility in which the machine is operated. The crane can be maneuvered by an operator to lower replacement rolls 245 into the upper roll replacement system 241. The crane system 261 enables each roll 245 to be loaded, raised, and placed into position for use.

A lower roll replacement system 265 is provided for the moveable carriage 45 on the bottom of the packaging machine 1. The lower roll replacement system 265 is substantially similar to the upper roll replacement system 241 in that the lower system includes a gravity feed system 267 including two gates that are operable by two handles 271, 273 mounted on the lower roll replacement system. Replacement rolls 275 can be loaded into the lower roll replacement system 265 from the crane system 261 or directly from a forklift (not shown) or other lifting mechanism.

The machine 1 of the illustrated embodiment includes an upper packaging material sensor 52 mounted on the frame 23 generally near the top of the product receiving area 5 near the input end 25 of the machine 1 to detect when the upper roll 11 of packaging material is empty. The packaging material sensor 52 is positioned to direct a beam of light at the top of the packaging area 5 that is directed at a reflector (not shown) mounted on the frame. The sensor 52 is positioned such that the beam of light is interrupted by the upper web 13 that extends at a slight downward angle from the upper roll 11 mounted on the cradle rollers 53 to the pinch rollers 47 when the machine is operating. When the upper roll 11 of packaging material is empty, the free end of the upper web 13 will hang loosely down from the pinch rollers 47 at the top of the machine 1 in the product receiving area 5 exposing the reflector to the beam of light from the sensor 52. When the beam of light from the sensor 52 is reflected by the reflector, the sensor detects that the upper roll has run out of packaging material and the machine is shutdown to allow an operator to load a new roll of packaging material. The web of packaging material from the new roll and the web of packaging material from the expired roll must be joined together to reform the upper web 13 before the machine 1 is restarted. It is understood that a lower packaging material sensor (not shown) operates in a similar manner as the upper packaging material sensor 52 to detect when the packaging material 3 from the bottom roll 17 has run out.

The machine 1 has a manual sealing assembly, generally indicated at 277 (FIG. 1B), mounted on a crossbar of the frame 23 at the input end 25 of the machine for joining the web of material from the new roll to the web of material from the expired roll. The manual sealing assembly 277 is generally similar to the lower sealing assemblies 89 used to seal the upper and lower webs 13, 17 in the packaging area 7 of the machine. To join the web of packaging material from the new roll and the web of packaging material from the expired roll, an operator places the two edge margins of the webs to be joined on the manual seal assembly 277 in overlapping arrangement and uses a hand sealer assembly (not shown) to press down on and heat the overlapping portions of the webs so that the webs are bonded together to reform the upper web 13 of packaging material 3. In one embodiment, the operator uses the hand sealer to form two spaced apart thermal bonds that connect the new web of packaging material with the web of packaging material from the expired roll. After the webs have been bonded together, the machine 1 is restarted and the next product P is feed through the machine. It is understood that the lower web 19 of packaging material 3 may be reformed after the packaging material 3 from the lower roll 17 runs out by use of the manual sealing assembly 277 and hand sealer as described above for the upper web 13.

As shown in FIG. 1A, an upper edge wrapping material applicator, generally indicated at 281, is positioned above the inlet end 25 of the machine 1 and lower edge wrapping material applicator, generally indicated at 283, is positioned below the inlet end of the machine. The upper end wrapping material applicator 281 includes a first and second roll 285, 287 of end wrapping material that is positioned for dispensing end wrapping material to the left and right sides LS, RS of the mattress P. Typically, the edge wrapping material is a thicker plastic film than the packaging material 3 and provides additional protection to the sides LS, RS of the mattress P. The upper edge wrapping material applicator 281 applies edge wrapping material that is coextensive with the upper web 13 of packaging material 3 and the lower edge wrapping material applicator 283 applies edge wrapping material that is coextensive with the lower web 19 of packaging material such that the edge wrapping material is sealed simultaneously when the webs of packaging material are sealed by the end sealing assembly 77 and right and left side sealing assemblies 81, 83 of the machine 1. It is understood that the manual sealing assembly 277 and hand sealer may be used in a similar manner as described above for the upper web 13 of packaging material to reattach edge wrapping material from the upper edge wrapping material applicator and/or the lower edge wrapping material when the corresponding rolls of edge wrapping material run out of material.

The packaging machine 1 of the present invention is operated to package the product such as the mattress P shown in the illustrated embodiment in a protective enclosure of packaging material 3. The mattress P is loaded on the product receiving area 5 at the inlet end 25 of the machine and is moved by the conveyors 31, 33 along the path of travel in the machine until the downstream end D of the mattress reaches the gate at the end of the product receiving area of the machine. The moveable guide 37 is actuated to laterally position that mattress P in the product receiving area 5 so that the mattress is correctly aligned for packaging. After the mattress P has been properly positioned against the stationary side guide 39, the gate is lowered and the mattress P is allowed to pass into the packaging area 7. As the mattress P passes into the packaging area 7, the upper and lower drive roller motors are actuated to pull the upper and lower webs 13, 19 of packaging material. The downstream end D of the mattress P engages the seal between the upper and lower webs 13, 19 at the inlet of the packaging area 7 that is preformed to create the seal at the downstream end of the mattress being packaged. The mattress P is enveloped by the plastic packaging material 3 to form an open ended sleeve, with the left and right sides LS, RS and upstream end U of the mattress P remaining unclosed. Once the mattress P enters the packaging area 7, the tension roller 51 is activated to press against the top surface of the mattress as it moves through the packaging area. The tension roller 51 provides a downward force on the mattress P that increases the traction of the belts 38 of the conveyors 32, 34 in the packaging area 7. When the upstream end U of the mattress P has cleared the end sealing assembly 77, the end sealing assembly is then actuated to seal the upper and lower webs 13, 19 of packaging material 3 at the upstream end and to cut the upper and lower webs to form the seal at the downstream end D of the next mattress to be packaged. The mattress P advances further into the packaging area 7 where the left and right side compression assemblies 201 are actuated to press against the left and right sides LS, RS of the mattress P to flatten the upper web 13 of packaging material 3 so that the packaging material forms a close fit to the mattress. It is understood that the compression assemblies 201 push down on the mattress P and compact the height of the mattress at least approximately two inches to provide a tight fit of the packaging material 3. The resulting compression of the mattress P by the compression assemblies 201 allows the width of the upper web 13 of packaging material to be reduced by at least approximately two inches to approximately four inches as compared to the width of the upper web that is needed if the compression assemblies are not used. In this way, the packaging machine 1 with compression assemblies 201 uses less packaging material 3 than packaging machines without compression assemblies because the effective height of the mattress P being package is reduced by the compression assemblies. After the compression assemblies 201 are actuated, the upper sealing assembly 87 of each of the left and right side sealing assemblies 81, 83 is actuated so as to create the left and right side seal between the upper and lower webs 13, 19 of packaging material 3. After, the left and right side seals are formed the packaged mattress P is ejected from the packaging machine 1 and the next mattress to be packaged is sent through the machine.

In view of the above, it will be seen that several advantageous results are obtained by the packaging machine 1 of the present invention. For example, the seal bars 121, 123 of the upper sealing assemblies 87 of the packaging machine 1 can be assembled easily, without the use of any gauges or fixtures. The upper sealing assemblies 87 can be configured with the seal bar(s) 121, 123 and/or cutting blade 125 in multiple different orientations, with one of the most common set ups being shown in FIG. 6 for the cross seal, to seal across the upstream end U of the mattress P, cut, and form the seal at the downstream end D of the next mattress to be packaged. The cutting blade 125 can be configured with a continuous sharp edge or with notches for "perforating" the trim, which allows trim to be removed either manually or automatically. The heating element 151 is located in the upper sealing assembly 87 in a position to heat the seal bars 121, 123 and/or cutting blade 125, with the blade 125 being the primary point of heat transfer in those embodiments that include a cutting blade. Typically, a single heating element 151 is used in each upper sealing assembly 87 although additional heating elements could be used without departing from the scope of this invention. The seal bars 121, 123 and cutting blade 125 can be replaced without complete removal of the upper sealing assembly 87 from the frame 23 by simply removing the seal bars and cutting blade from the mounting bracket 107 while the bracket remains attached to the support 97. The packaging machine 1 of the present invention can be configured for virtually any length for cut and seal (or just seal) applications outside the mattress or bedding industry. Heat resistant Teflon tape or coating can be utilized to create a "non stick surface" on the sealing elements 91, 93 of the upper or lower sealing assembly 87, 89 to reduce maintenance time required for replacement and repair of the sealing elements. The reversible seal bar design of the present invention 1 allows the useable life of the seal bars 121, 123 to be extended by providing a second sealing surface 145 that is available after the first sealing surface 143 is no longer in condition for use. The shields 117 mounted on the lower edge of the guards 109, 111 hold the packaging material 3 and prevent the material from making contact with the seal bars 121, 123 until the seal bar meets the Teflon tape 173 mounted on the lower sealing assembly 89. The shields 117 also serve as a heat shield for the guards 109, 111 to prevent or reduce the transmission of heat from the heating elements 151 to the guards. The lower sealing assembly 89 has a "trough shape" which holds the sponge layers 169, 171 and silicone layer 167 in a position generally aligned for contact with the upper sealing assembly 87. The Teflon tape 173 adheres to the support 161 and the upper layer of the sponge 169 so that the tape remains flat in a substantially fixed position on the support to provide a non-stick, heat resistant surface for the seal bars 121, 123 to press and seal the packaging material 3 against. The replaceable Teflon tape 173 can be quickly and easily replaced by dispensing a new portion of tape from the dispenser 177 and attaching the new portion of tape to the support 161. An optional safety mat (not shown) can be used with the packaging machine 1 including a pressure sensitive switch electrically connected to the control panel and placed under a rubber pad to ensure that the power to the machine shuts off when the operator steps off the mat.

It will be further understood by those skilled in the art that while the foregoing has been disclosed above with respect to preferred embodiments or features, various additions, changes, and modifications can be made to the foregoing invention without departing from the spirit and scope of thereof.

What is claimed is:

1. A packaging machine for packaging a product, the machine comprising:

a frame for supporting the product in the machine, the frame having an input end and an output end:

a conveyor for moving the product along a path of travel from said input end toward said output end;

a first source of packaging material mounted on the frame for supplying a first web of packaging material;

a second source of packaging material mounted on the frame for supplying a second web of packaging material, the first and second webs of packaging material being adapted to at least partially surround the product when the product is moved from the input end towards the output end of the machine;

at least one upper sealing assembly moveably mounted on the frame for movement between an actuated position and a non-actuated position, the upper sealing assembly comprising at least one sealing element for forming a bond between the first and second webs of material; and at least one lower sealing assembly mounted on the frame in a position adapted for cooperating engagement with the upper sealing assembly when the upper sealing assembly is in its actuated position with the first and second webs engaged therebetween for forming the bond between the first and second webs of material, the lower sealing assembly comprising a support and a replaceable lower sealing element having a nonstick sealing surface formed from a nonstick material received and releasibly mounted on the support of the lower sealing assembly, and wherein the nonstick material comprises a replaceable roll of a heat resistant, nonstick tape mounted on the lower sealing assembly.

2. The machine of claim 1 wherein the tape material comprises a polytetrafluoroethylene tape having an adhesive layer for attachment of the tape to the lower sealing assembly.

3. The machine of claim 1 wherein the lower sealing assembly comprises a tape dispenser for dispensing the tape material, the tape dispenser comprising a holder for holding the replaceable roll and a roller mounted on the holder for dispensing the tape material to the lower sealing assembly.

4. A packaging machine for packaging a product, the machine comprising:

a first source of packaging material mounted in a position for supplying a first web of packaging material;

a second source of packaging material mounted in a position for supplying a second web of packaging material, the first and second webs of packaging material being adapted to at least partially surround the product when the product is moved from an input end toward an output end of the machine;

wherein the first and second sources of packaging material each comprises a roll of packaging material, and the machine further comprises a first and a second feed roller to supply packaging material from a respective roll, the feed rollers comprising a brake to stop the supply of packaging material from a respective one of the first and second rolls;

at least one upper sealing assembly moveably mounted for movement between an actuated position and a non-actuated position, the upper sealing assembly comprising at least one sealing element for forming a bond between the first and second webs of material; and at least one lower sealing assembly mounted in a position adapted for cooperating engagement with the upper sealing assembly when the upper sealing assembly is in its actuated position with the first and second webs engaged therebetween for forming the bond between the first and second webs, the lower sealing assembly comprising a support and a replaceable lower sealing element having a nonstick surface.

5. A packaging machine for packaging a product, the machine comprising:

a frame for supporting the product in the machine, the frame having an input end and an output end;

a first source of packaging material mounted on the frame for supplying a first web of packaging material;

a second source of packaging material mounted on the frame for supplying a second web of packaging material, the first and second webs of packaging material being adapted to at least partially surround the product when the product is moved from the input end towards the output end of the machine;

at least one upper sealing assembly moveably mounted on the frame for movement between an actuated position and a non-actuated position, the upper sealing assembly comprising at least one sealing element for forming a bond between the first and second webs of material;

at least one cylinder for moving the upper sealing assembly to the actuated position, the cylinder including a brake mechanism for maintaining the upper sealing assembly in its raised, non-actuated position upon deactivation of the cylinder; and at least one lower sealing assembly mounted on the frame in a position adapted for cooperating engagement with the upper sealing assembly when the upper sealing assembly is in its actuated position with the first and second webs engaged therebetween for forming the bond between the first and second webs, the lower sealing assembly comprising a support and a replaceable lower sealing element having a nonstick surface.

6. A method of packaging products, the method comprising:

moving the product along a path of travel;

feeding a first web of packaging material and a second web of packaging material into registration with the product moving along its path of travel;

moving a series of upper sealing assemblies, each having a respective upper sealing elements into engagement with a series of lower sealing assemblies, each having a respective lower sealing element including a roll of a replaceable nonstick material extending therealong;

forming a thermal bond between the webs by clamping engagement of the webs between the respective sealing elements of the upper and lower sealing assemblies; and when the nonstick material of the lower sealing element needs replacement, detaching a used portion of the nonstick material from the lower sealing assembly;

unwinding the roll of nonstick material to expose a new portion of nonstick material; and adhesively attaching the new portion of nonstick material to the lower sealing assembly.

7. A method of packaging products, the method comprising:

moving the product along a path of travel;

feeding a first web of packaging material and a second web of packaging material into registration with the product moving along its path of travel;

moving a series of upper sealing assemblies, each having an upper sealing element, into engagement with a series of lower sealing assemblies, each having a lower sealing element including a roll of a replaceable nonstick material extending therealong, wherein the sealing element of the upper sealing assembly is includes a seal bar having a first sealing surface comprising a first longitudinal edge of the seal bar and a second sealing surface comprising a second longitudinal edge of the seal bar, wherein the seal bar is mounted on the upper sealing assembly and wherein the first sealing surface is exposed for bonding the packaging material, forming a thermal bond between the webs by clamping engagement of the webs between the respective sealing elements of the upper and lower sealing assemblies; and when the nonstick material of the lower sealing element needs replacement, removing the seal bar from the upper sealing assembly, reversing the orientation of the seal bar to expose the second sealing surface, and attaching the seal bar to the upper sealing assembly.

8. A packaging machine for packaging a product, the packaging machine comprising:

a frame for supporting the product as the product is moved along a path of travel in a flat-lying attitude;

a source of packaging material positioned on the frame for supplying packaging material into a position to be engaged by and pulled from the source and thereafter at least partially surround the product as the product is moved along its path of travel;

at least one upper sealing assembly moveably mounted on the frame and adapted to move between an actuated position and a non-actuated position, the upper sealing assembly comprising at least one upper sealing element for forming a seal along adjacent edges of the packaging material;

at least one lower sealing assembly mounted on the frame in a position to cooperatively engage the upper sealing assembly in its actuated position, the lower sealing assembly comprising a support, a lower sealing element mounted on the support, and a heat resistant, nonstick fluoropolymer tape material having an adhesive layer for removably attaching the tape material to the support, and a tape dispenser for dispensing the tape material for attachment to the support;

the at least one upper and lower sealing assemblies being positioned for clamping engagement of the packaging material therebetween for forming the seal when the upper sealing assembly is moved to its actuated position in engagement with the lower sealing assembly.

9. The machine of claim 8 wherein the tape dispenser comprises a holder for holding replaceable roll of the tape material at a first end of the support and a fastener for attachment of the tape at a second end of the support.

10. The machine of claim 9 wherein the dispenser comprises a roller mounted on the holder for dispensing the tape material to the support.

11. The machine of claim 8 wherein the support comprises a trough-shaped member.

* * * * *